US005216997A

United States Patent [19]

Osanai et al.

[11] Patent Number: 5,216,997

[45] Date of Patent: Jun. 8, 1993

[54] FUEL SUPPLY CONTROL DEVICE OF AN ENGINE

[75] Inventors: Akinori Osanai; Takaaki Itoh; Yoshihiko Hyodo; Toru Kodokoro, all of Susono, Japan

[73] Assignee: Toyota Jidosha Kabushiki Kaisha, Toyota, Japan

[21] Appl. No.: 932,846

[22] Filed: Aug. 20, 1992

[30] Foreign Application Priority Data

Aug. 23, 1991 [JP] Japan ..... 3-212360

[51] Int. Cl.[5] ..... F02D 41/04; F02M 25/08

[52] U.S. Cl. ..... 123/698; 123/520; 123/198 DB

[58] Field of Search ..... 123/198 DB, 325, 518, 123/519, 520, 698

[56] References Cited

U.S. PATENT DOCUMENTS

| | | | |
|---|---|---|---|
| 4,326,489 | 4/1982 | Heitert | 123/520 |
| 4,641,623 | 2/1987 | Hamburg | 123/518 |
| 4,715,340 | 12/1987 | Cook et al. | 123/520 X |
| 4,748,959 | 6/1988 | Cook et al. | 123/698 X |
| 4,932,386 | 6/1990 | Uozumi et al. | 123/520 |
| 4,986,070 | 1/1991 | Abe | 60/285 |
| 5,060,621 | 10/1991 | Cook et al. | 123/520 |
| 5,090,388 | 2/1992 | Hamburg et al. | 123/698 X |
| 5,143,040 | 9/1992 | Okawa et al. | 123/698 X |
| 5,150,686 | 9/1992 | Okawa et al. | 123/698 |

FOREIGN PATENT DOCUMENTS

| | | |
|---|---|---|
| 56-101051 | 8/1981 | Japan . |
| 56-143336 | 11/1981 | Japan . |
| 57-86555 | 5/1982 | Japan . |
| 60-159360 | 8/1985 | Japan . |
| 63-57841 | 3/1988 | Japan . |
| 63-186955 | 8/1988 | Japan . |
| 64-87866 | 3/1989 | Japan . |
| 219631 | 1/1990 | Japan . |
| 2245441 | 10/1990 | Japan . |
| 2066360A | 7/1981 | United Kingdom . |

*Primary Examiner*—Willis R. Wolfe
*Attorney, Agent, or Firm*—Kenyon & Kenyon

[57] ABSTRACT

A fuel supply control device including a purge control valve. The maximum purge rate, that is, the ratio between the amount of purge and the amount of intake air when the purge control valve is fully open, is stored in advance. The purge control valve is controlled in its duty ratio, which duty ratio is the target purge rate/-maximum purge rate. When the purge is started, the target duty ratio is gradually increased. When the purge is performed and the feedback correction coefficient FAF falls, the feedback correction coefficient FAF is gradually returned to the FAF before the start of a purge, the purge A/F correction coefficient is increased, and the amount of injection is corrected by the sum of the purge A/F correction coefficient and the feedback correction coefficient.

16 Claims, 12 Drawing Sheets

FUEL SUPPLY CONTROL DEVICE OF AN ENGINE

BACKGROUND OF THE INVENTION

1. Field of the Invention

The present invention relates to a fuel supply control device of an engine.

2. Description of the Related Art

Known in the prior art is an internal combustion engine which is provided with a canister for temporarily storing vaporized fuel, has an air-fuel ratio sensor arranged in the engine exhaust passage, and corrects the amount of fuel injection by a feedback correction coefficient so that the air-fuel ratio becomes a target air-fuel ratio. In this internal combustion engine, when the vaporized fuel stored in the canister is not purged inside the engine intake passage, the feedback correction coefficient changes about a reference value, for example, 1.0. Next, when the purge is started, the amount of fuel injection must be reduced by the amount of vaporized fuel purged so as to maintain the air-fuel ratio at the stoichiometric air-fuel ratio, so the feedback correction coefficient becomes smaller, then for a while after that the feedback correction coefficient is maintained at the small value.

In this case, if, for example, it is assumed that the air-fuel ratio fluctuates 20 percent due to the purged vaporized fuel, the amount of fuel injection must be reduced 20 percent, therefore, the feedback correction coefficient becomes 0.8. If, however, the engine is accelerated in this state and, for example, the amount of intake air becomes double, if the amount of fuel vapor purged is the same, the amount of fluctuation of the air-fuel ratio due to the fuel vapor becomes 10 percent and therefore unless the feedback correction coefficient rises to 0.9, the air-fuel ratio cannot be maintained at the stoichiometric air-fuel ratio.

The feedback correction coefficient, however, is determined so as to change relatively slowly by a predetermined integration constant so as to avoid sudden changes in the air-fuel ratio, so it takes time for the feedback correction coefficient to rise from 0.8 to 0.9 and the air-fuel ratio during that period deviates by a large amount to the lean side with respect to the stoichiometric air-fuel ratio. To prevent the air-fuel ratio from deviating by a large amount with respect to the stoichiometric air-fuel ratio, it becomes necessary to maintain the feedback correction coefficient as much as possible near the reference value, that is, 1.0, even during a purge.

There is known an internal combustion engine (see Japanese Unexamined Patent Publication No. 2-19631) wherein it is attempted to return the feedback correction coefficient to the reference value at the same time as reducing the amount of fuel injection by the amount of reduction of the feedback correction coefficient when a purge is performed and the feedback correction coefficient becomes small.

Even if the feedback correction coefficient is returned to the reference value in this way, however, if the engine is accelerated during the purge action, the air-fuel ratio fluctuates considerably. That is, if the opening of the purge control valve is constant, the amount of purge decreases the smaller the negative pressure in the intake air passage. Therefore, the less the concentration of the purge vapor in the intake air and the more the increase air, the less the concentration of the purge vapor in the intake air. Therefore, at times like acceleration, the negative pressure in the intake passage becomes smaller and further when the amount of intake air increases, the concentration of the purge vapor in the intake air decreases considerably.

Therefore, if there is acceleration during the purge, even if the feedback correction coefficient is returned to the reference value such as in the above-mentioned internal combustion engine, the concentration of the purge vapor in the intake air drops considerably, so the problem arises that the air-fuel ratio becomes lean.

SUMMARY OF THE INVENTION

An object of the present invention is to provide a fuel supply control device capable of preventing an air-fuel ratio from fluctuating when the engine is accelerated or decelerated.

According to the present invention, there is provided a fuel supply control device of an engine having an exhaust passage and an intake passage which has a throttle valve therein, the device comprising a charcoal canister temporarily storing fuel vapor therein; a purge passage connecting the charcoal canister to the intake passage downstream of the throttle valve; a purge control valve arranged in the purge passage to control an amount of the fuel vapor purged into the intake passage; reference purge rate calculating means for calculating a reference purge rate which is a ratio of the amount of the fuel vapor purged into the intake passage to an amount of air fed into the engine and is determined by an engine operating state for the same degree of opening of the purge control valve; target purge rate setting means for determining a target purge rate; opening operation control means for controlling a rate of the opening operation of the purge control valve on the basis of a ratio of the target purge rate to the reference purge rate; fuel amount calculating means for calculating an amount of fuel fed into the engine; air-fuel ratio detecting means arranged in the exhaust passage to detect an air-fuel ratio; first fuel amount correcting means for correcting the amount of fuel by a feedback correction coefficient on the basis of an output signal of the air-fuel ratio detecting means to make an air-fuel ratio equal to a target air-fuel ratio; vapor concentration calculating means for calculating a concentration of the fuel vapor in an air fed into the engine on the basis of a deviation of the feedback correction coefficient from a reference value, which deviation is caused when the fuel vapor is purged into the intake passage; and second fuel amount correcting means for reducing the amount of fuel on the basis of the concentration of the fuel vapor when the fuel vapor is purged into the intake passage.

DESCRIPTION OF A PREFERRED EMBODIMENT

Figure 1:
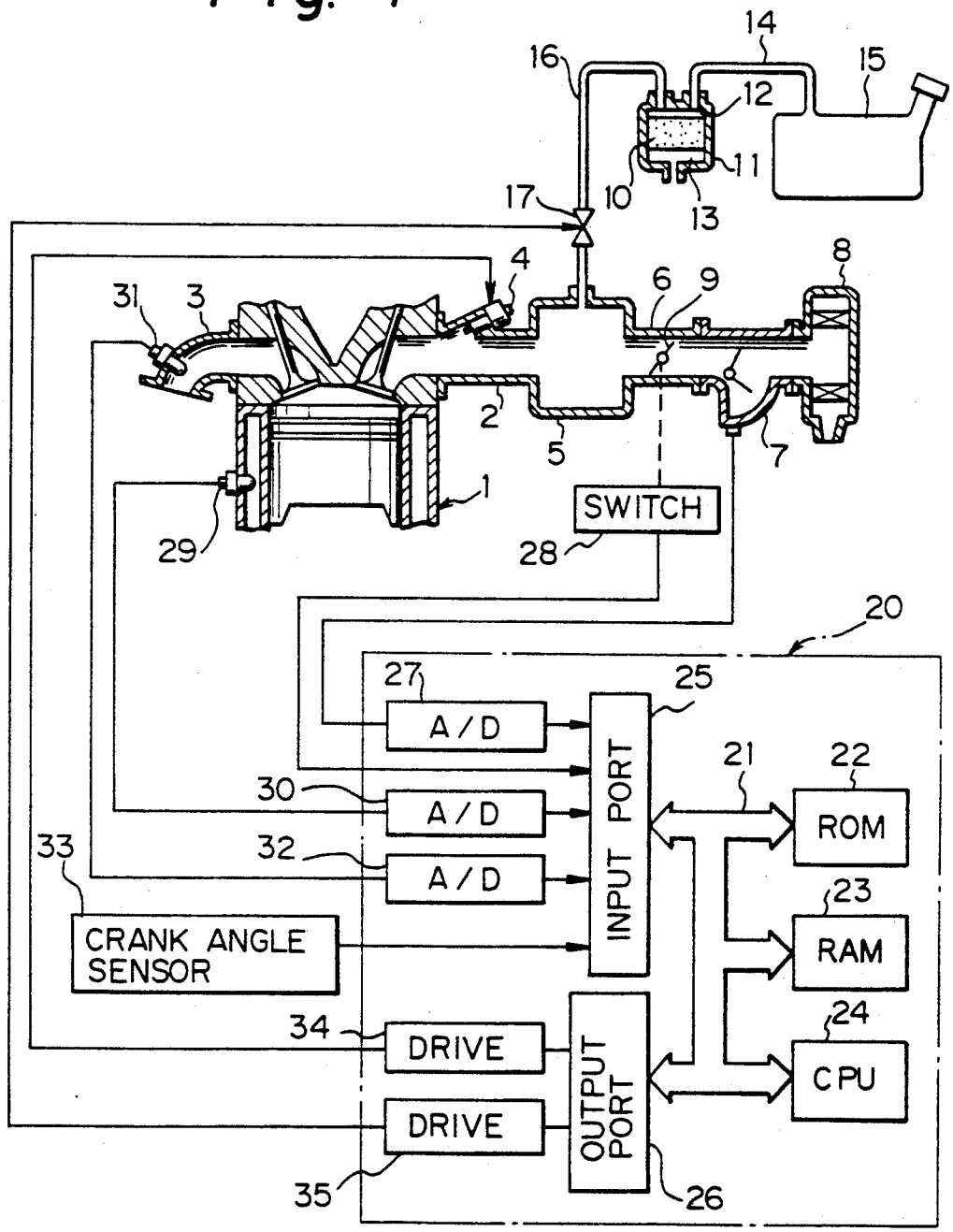
FIG. 1 is an overall view of an internal combustion engine.

Referring to FIG. 1, 1 is an engine body, 2 intake branching pipes, 3 an exhaust manifold, and 4 fuel injectors attached to the intake branching pipes 2. The intake branching pipes 2 are connected to a common surge tank 5, which surge tank 5 is connected through the intake duct 6 and air flow meter 7 to an air cleaner 8. In the intake duct 6 is arranged a throttle valve 9. Further, as shown in FIG. 1, the internal combustion engine is provided with a canister 11 housing activated charcoal 10. This canister 11 has a fuel vapor chamber 12 and an atmospheric chamber 13 at the two sides of the activated charcoal 10. The fuel vapor chamber 12 is connected through a conduct 14 to the fuel tank 15 on the one hand and is connected through the conduit 16 inside the surge tank 5 on the other hand. In the conduit 16 is arranged a purge control valve 17 controlled by an output signal of the electronic control unit 20. The fuel vapor occurring in the fuel tank 15 is fed into the canister 11 through the conduit 14 and absorbed in the activated charcoal. When the purge control valve 17 opens, the air is sent in from the atmospheric chamber 13 through the activated charcoal 10 into the conduit 16. When the air passes through the inside of the activated charcoal 10, the fuel vapor absorbed in the atmospheric chamber 10 is separated from the atmospheric chamber 10 and then the air containing the fuel, that is, the fuel vapor, is purged inside the surge tank 5.

The electronic control unit 20 is comprised of a digital computer and is provided with a ROM (read only memory) 22, a RAM (random access memory) 23, a CPU (microprocessor) 24, an input port 25, and an output port 26, all connected with each other by a bidirectional bus 21. The air flow meter 7 generates an output pulse proportional to the amount of intake air, which output voltage is input through an AD converter 27 to an input port 25. The throttle valve 9 has a throttle switch 28 attached to it which turns on when the throttle valve 9 is in the idling opening position. The output signal of the throttle switch 28 is input to the input port 25. The engine body 1 has attached to it a water temperature sensor 29 which generates an output voltage proportional to the engine cooling water temperature. The output voltage of the water temperature sensor 29 is input to the input port 25 through an AD converter 30. The exhaust manifold 3 has an air-fuel ratio sensor 31 attached to it, the output signal of the air-fuel ratio sensor 31 being input to the input port 25 through an AD converter 32. Further, the input port 25 has connected to it a crank angle sensor 33 which generates an output pulse each time the crankshaft rotates, for example, by 30 degrees. In the CPU 24, the engine rotational speed is calculated based on the output pulse. On the other hand, the output port 26 is connected through the corresponding drive circuits 34 and 35 to the fuel injectors 4 and the purge control valve 17.

In the internal combustion engine shown in FIG. 1, basically the fuel injection time TAU is calculated based on the following equation:

$$TAU = TP \cdot \{1 + K + (FAF - 1) + FPG\}$$

Here, the coefficients express the following:

TP: Basic fuel injection time

K: Correction coefficient

FAF: Feedback correction coefficient

FPG: Purge A/F correction coefficient

The basic fuel injection time TP is the injection time found by experiments to be necessary for making the air-fuel ratio the target air-fuel ratio. The basic fuel injection time TP is stored in advance in the ROM 22 as a function of the engine load Q/N (intake air amount Q/engine rotational speed N) and the engine rotational speed N.

The correction coefficient K expresses together the coefficient of increase during warm-up and the coefficient of increase during acceleration. When there is no need for correction to increase the amount, K becomes zero.

The purge A/F correction coefficient FPG is for correction of the amount of injection when a purge is performed, therefore, when purge is not performed, FPG becomes zero.

The feedback correction coefficient FAF is for controlling the air-fuel ratio to the target air-fuel ratio based on the output signal of the air-fuel ratio sensor 31. As the target air-fuel ratio, use may be made of any air-fuel ratio, but in the embodiment shown in FIG. 1, the target air-fuel ratio is made the stoichiometric air-fuel ratio and therefore an explanation will be made of the case where the target air-fuel ratio is made the stoichiometric air-fuel ratio. Note that when the target air-fuel ratio is the stoichiometric air-fuel ratio, use is made as the air-fuel ratio sensor 31 of a sensor where the output voltage changes in accordance with the concentration of oxygen in the exhaust gas. Therefore, below, the air-fuel ratio sensor 31 is referred to as an $O_2$ sensor. The $O_2$ sensor 31 generates an output voltage of about 0.9 V when the air-fuel ratio is overly higher, that is, on the rich side, while generates an output voltage of about 0.1 V when the air-fuel ratio is overly low, that is, on the lean side. First, an explanation will be made of the control of the feedback correction coefficient FAF performed based on the output signal of the $O_2$ sensor 31.

Figure 2:
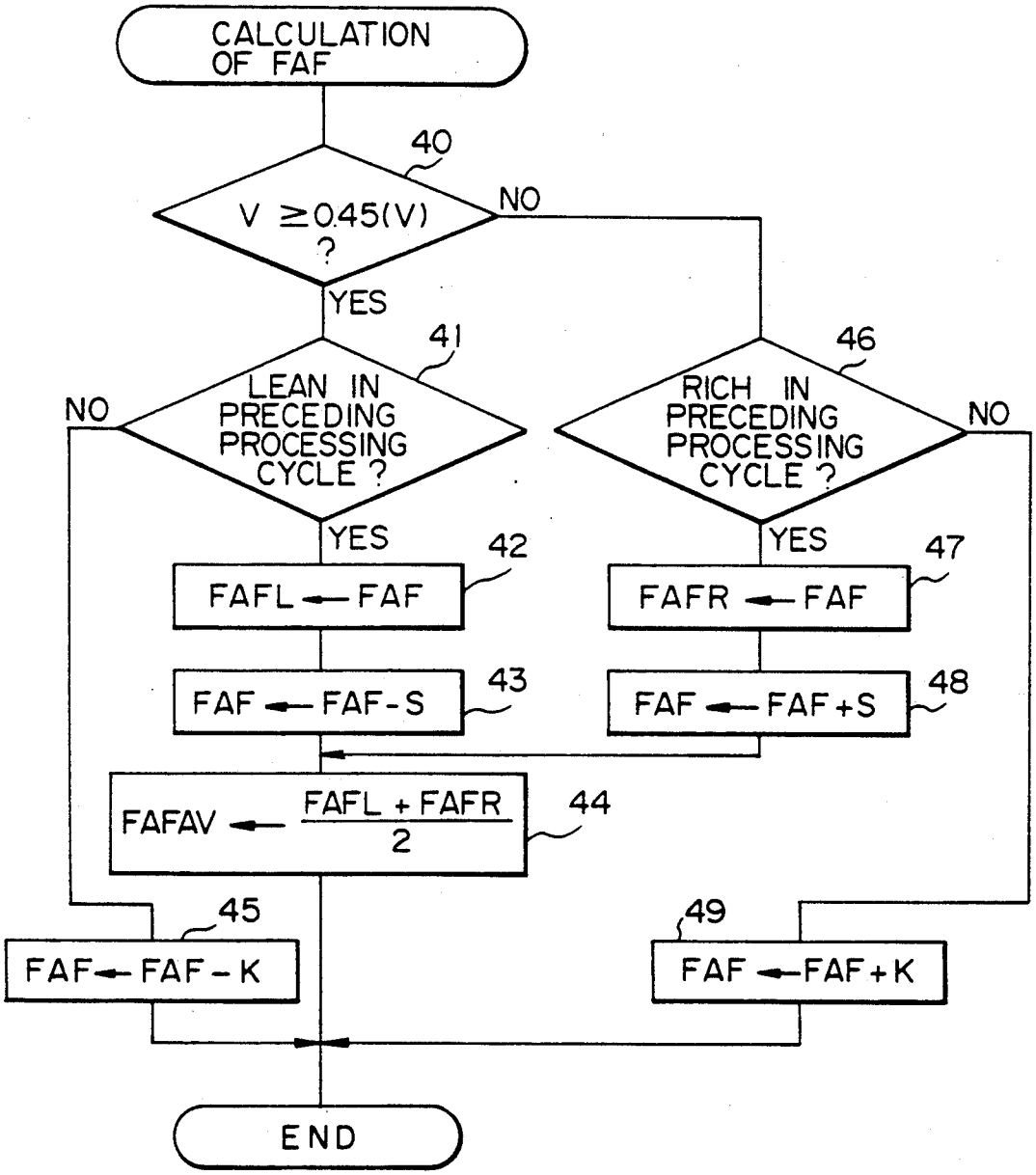
FIG. 2 is a flow chart for calculating the feedback correction coefficient.

FIG. 2 shows a routine for calculation of the feedback correction coefficient FAF. This routine is executed, for example, in the main routine.

Figure 3:
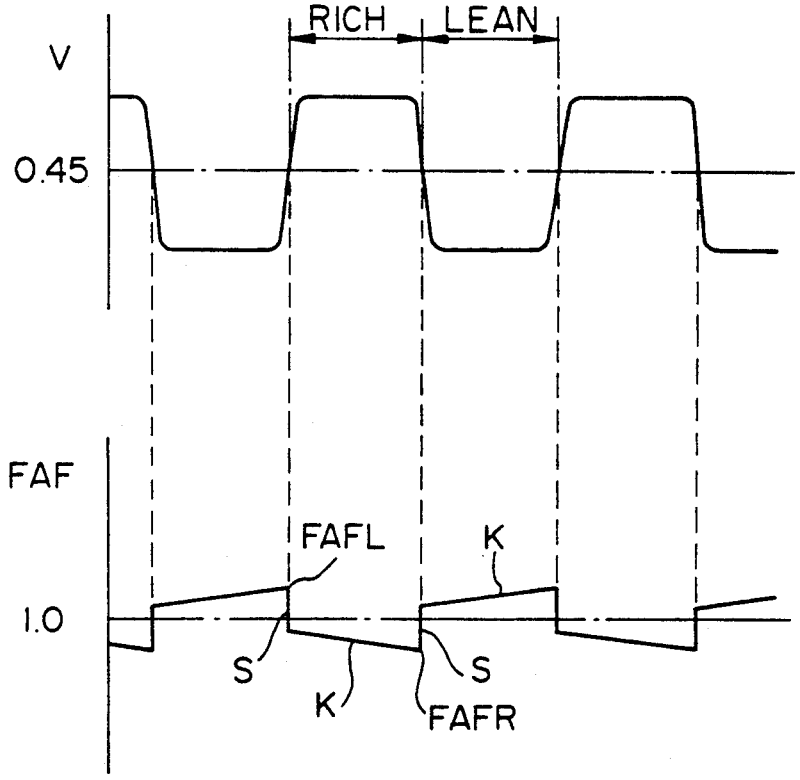
FIG. 3 is a graph showing the change in the feedback correction coefficient.

Referring to FIG. 2, first, at step 40, it is determined if the output voltage V of the $O_2$ sensor 31 is higher than 0.45 V, that is, if the air-fuel ratio is rich. When $V \geqq 0.45$ V, that is the air-fuel ratio is rich, the routine proceeds to step 41, where it is determined if the air-fuel ratio was lean in the previous processing cycle. When lean in the previous processing cycle, that is, when changing from lean to rich, the routine proceeds to step 42, where the feedback correction coefficient FAF is made FAFL and the routine proceeds to step 43. At step 43, the skip valve S is subtracted from the feedback correction coefficient FAF, therefore, as shown in FIG. 3, the feedback correction coefficient FAF is reduced rapidly by the skip value S. Next, at step 44, the average value FAFAV of FAFL and FAFR is calculated. On the other hand, when it is determined at step 41 that the air-fuel ratio in the previous processing cycle was rich, the routine proceeds to step 45, where the integration value K ($K << S$) is subtracted from the feedback correction coefficient FAF. Therefore, as shown in FIG. 3, the feedback correction coefficient FAF is gradually reduced.

On the other hand, when it is determined at step 40 that V<0.45 V, that is, the air-fuel ratio is lean, the routine proceeds to step 46, where it is determined if the air-fuel ratio in the previous processing cycle was rich. When the air-fuel ratio was rich in the previous processing cycle, that is, the air-fuel ratio changed from rich to lean, the routine proceeds to step 47, where the feedback correction coefficient FAF is made FAFR and the routine proceeds to step 48. At step 48, the skip value S is added to the feedback correction coefficient FAF, therefore, as shown in FIG. 3, the feedback correction coefficient FAF is increased rapidly by exactly the skip value S. Next, at step 44, the average value FAFV of FAFL and FAFR is calculated. On the other hand, when it is determined at step 46 that the air-fuel ratio in the previous processing cycle was lean, the routine proceeds to step 49, where the integration value K is added to the feedback correction coefficient FAF. Therefore, as shown in FIG. 3, the feedback correction coefficient FAF is gradually increased.

When the air-fuel ratio becomes rich and FAF becomes smaller, the fuel injection time TAU becomes shorter, while when the air-fuel ratio becomes lean and FAF becomes larger, the fuel injection time TAU becomes longer, so the air-fuel ratio is held at the stoichiometric air-fuel ratio. Note that when no purge action is performed, as shown in FIG. 3, the feedback correction coefficient FAF fluctuates about 1.0. Further, as will be understood from FIG. 3, the average value FAFAV calculated at step 44 shows the average value of the feedback correction coefficient FAF.

As will be understood from FIG. 3, the feedback correction coefficient FAF is changed relatively slowly by the integration constant K, so if a large amount of purge vapor is purged rapidly in the surge tank 5 and the air-fuel ratio rapidly fluctuates, it becomes impossible to maintain the air-fuel ratio at the stoichiometric air-fuel ratio any longer and therefore the air-fuel ratio will fluctuate. Thus, in the embodiment shown in FIG. 1, to prevent fluctuation of the air-fuel ratio, when performing a purge, the amount of the purge is made to be gradually increased. If the amount of purge is gradually increased in this way, the air-fuel ratio can be held to the stoichiometric air-fuel ratio by the feedback control by the feedback correction coefficient FAF even during an increase of the purge and therefore it is possible to prevent fluctuation of the air-fuel ratio.

If there is acceleration during the purge, however, as mentioned in the beginning, the concentration of the purge vapor in the intake air fluctuates widely. Therefore, due to the wide fluctuation in the air-fuel ratio, even if the amount of the purge is increased, the air-fuel ratio will fluctuate. To prevent fluctuations in the air-fuel ratio at times of such transient operation, in the embodiment according to the present invention, the amount of the purge is controlled using a reference purge rate determined by the state of engine operation, for example, the maximum purge rate. Next, an explanation will be made of the method of control of the amount of the purge.

The maximum purge rate MAXPG expresses the ratio between the amount of the purge and the amount of intake air when the purge control valve 17 is fully opened. Examples of the maximum purge rate MAXPG are shown in the following Table 1.

TABLE 1

| | Q/N | | | | | | | | | | |
|---|---|---|---|---|---|---|---|---|---|---|---|
| N | 0.18 | 0.30 | 0.45 | 0.60 | 0.75 | 0.90 | 1.05 | 1.20 | 1.35 | 1.50 | 1.65 |
| 400 | 28.6 | 28.6 | 21.6 | 18.0 | 11.4 | 8.6 | 6.3 | 4.3 | 2.8 | 0.8 | 0 |
| 800 | 25.6 | 16.3 | 10.8 | 7.5 | 8.7 | 4.3 | 3.1 | 2.1 | 1.4 | 0.4 | 0 |
| 1600 | 16.6 | 8.3 | 5.5 | 3.7 | 2.8 | 2.1 | 1.8 | 1.2 | 0.9 | 0.3 | 0 |
| 2400 | 10.6 | 8.3 | 8.8 | 2.4 | 1.8 | 1.4 | 1.1 | 0.8 | 0.6 | 0.3 | 0.1 |
| 3200 | 7.8 | 3.9 | 2.6 | 1.8 | 1.4 | 1.1 | 0.9 | 0.6 | 0.5 | 0.4 | 0.2 |
| 4000 | 6.4 | 3.2 | 2.1 | 1.8 | 1.2 | 0.9 | 0.7 | 0.8 | 0.4 | 0.4 | 0.3 |

As will be understood from Table 1, the maximum purge rate MAXPG becomes larger the lower the engine load Q/N and becomes larger the lower the engine rotational speed N. When the purge is performed, first the target purge rate TGTPG is increased slowly by a certain rate, then when the target purge rate reaches a certain value, the target purge rate is held constant and the rate of opening of the purge control valve 17 is controlled in accordance with the ratio of the target purge rate TGTPG with respect to the maximum purge rate MAXPG. In the embodiment shown in FIG. 1, the duty ratio of the open time of the purge control valve 17 is controlled, so in this case the duty ratio of the open time of the purge control valve 17 is controlled in accordance with the ratio of the target purge rate TGTPG with respect to the maximum purge rate MAXPG.

That is, since the amount of the fuel vapor in the purge gas is not known, it is not known what the concentration of the purge vapor is in the intake air when the purge control valve 17 is fully opened. When the amount of fuel vapor absorbed into the activated charcoal of the canister 11 is the same, however, the concentration of the purge vapor in the intake air is proportional to the maximum purge rate MAXPG. Therefore, to make the concentration of the purge vapor in the intake air constant, it is necessary to enlarge the opening of the purge control valve 17 and increase the amount of the purge the smaller the maximum purge rate MAXPG becomes. In other words, when the target purge rate MAXPG is held constant, if the percent opening of the purge control valve 17 is controlled in accordance with the ratio of the target purge rate TGTPG with respect to the maximum purge rate MAXPG, that is, if the opening of the purge control valve 17 is made larger the smaller the maximum purge rate MAXPG, the concentration of purge vapor in the intake air becomes constant regardless of the state of engine operation and therefore even during transient operation, the air-fuel ratio will not fluctuate. On the other hand, while the target purge rate TGTPG is being gradually increased, the concentration of the purge vapor in the intake air increases in proportion to the target purge rate TGTPG and at that time even if there is transient operation, the concentration of the purge vapor in the intake air is proportional to the target purge rate TGTPG. That is, if the target purge rate TGTPG is the same, the concentration of the purge vapor is not affected at all by the engine operating state. Therefore, when the target purge rate TGTPG is increased, even if the engine is operated under acceleration, the air-fuel ratio does not fluctuate and the air-fuel ratio is continued to be held at the stoichiometric air-fuel ratio by feedback control by the feedback correction coefficient FAF.

Figure 4:
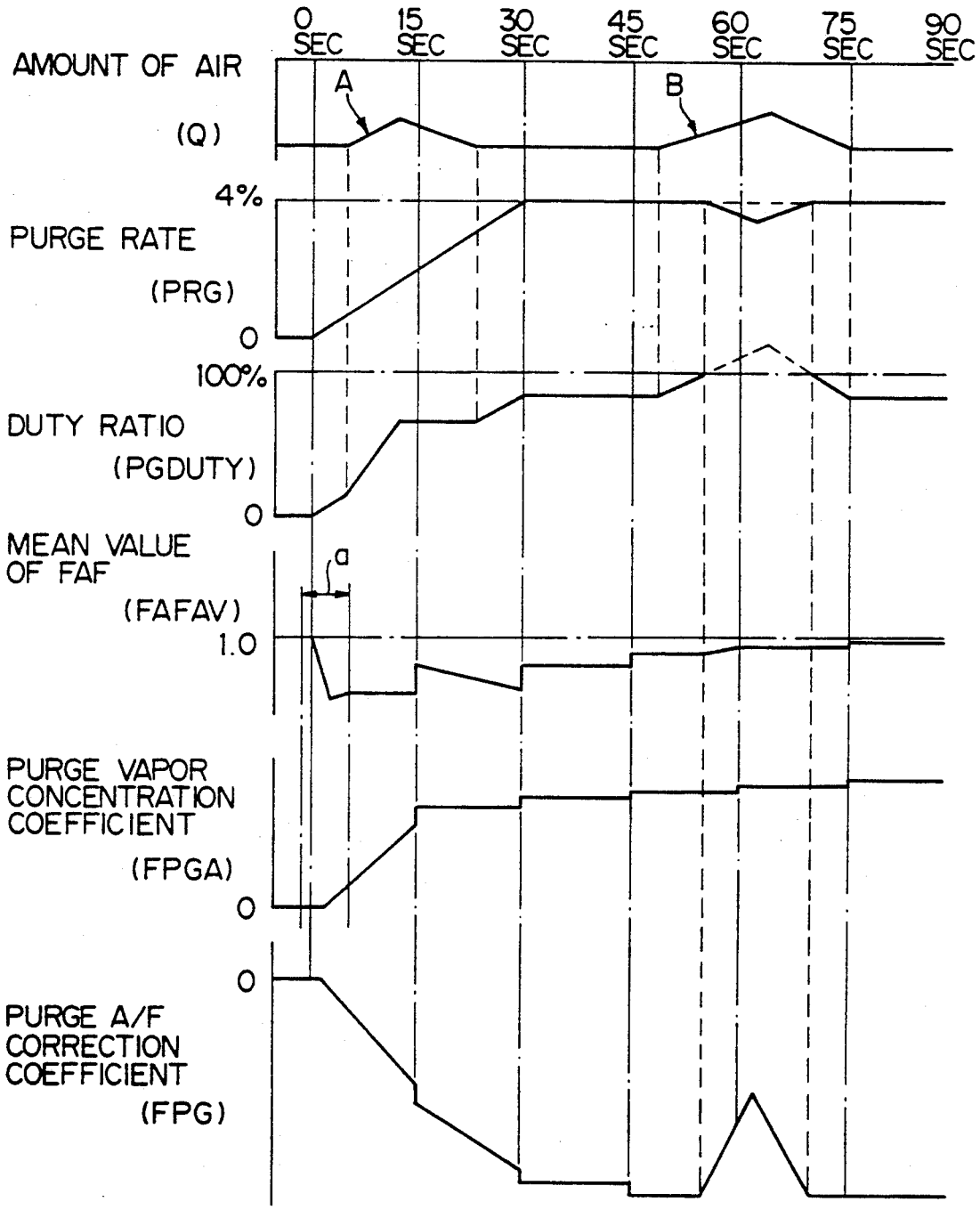
FIG. 4 is a time chart for the purge control.

In the time chart shown in FIG. 4, 0 second shows when the purge action was started. As shown in FIG. 4, when the purge action is started, usually the actual purge rate PRG, which increases along with the target purge rate TGTPG, is gradually increased. Next, as shown in A of FIG. 4, if there is acceleration and the amount Q of intake air increases, the maximum purge rate MAXPG becomes smaller and therefore, as shown in FIG. 4, the duty ratio PGDUTY with respect to the purge control valve 17 is controlled. As a result, as mentioned above, the concentration of the purge vapor in the intake air is increased proportionally to the increase of the purge rate PGT and therefore there is no fluctuation in the air-fuel ratio.

On the other hand, when the purge action is started, the feedback correction coefficient FAF for maintaining the air-fuel ratio at the stoichiometric air-fuel ratio becomes smaller and therefore, as shown in FIG. 4, the average value FAFAV of the feedback correction coefficient FAF gradually becomes smaller when the purge action is started. In this case, the amount of the decrease of the feedback correction coefficient FAF increases the higher the concentration of the purge vapor in the intake air. At this time, since the amount of decrease of the feedback correction coefficient FAF is proportional to the concentration of the purge vapor in the intake air, the concentration of the purge vapor in the intake air may be learned from the amount of decrease of the feedback correction coefficient FAF. In this case, as mentioned above, the concentration of the purge vapor is not affected by the transient operation. Even during a transient operation the concentration of the purge vapor is proportional to the target purge rate TGTPG. The product of the concentration of purge vapor per unit target purge rate and the purge rate is proportional to the target purge rate TGTPG even with a transient operation. Therefore, when the feedback correction coefficient FAF is reduced, it is possible to maintain the air-fuel ratio at the stoichiometric air-fuel ratio even during a transient operation if the amount of fuel injection is corrected based on the concentration of the purge vapor or the product of the concentration of the purge vapor per unit purge rate and the target purge rate. This is the basic thinking behind the present invention.

Next, a detailed explanation will be made of the correction of the amount of injection based on the concentration of the purge vapor.

When a purge is performed, the feedback correction coefficient FAF falls to a value corresponding to the concentration of the purge vapor in the intake air. The feedback correction coefficient FAF, however, falls due to other reasons as well, such as measurement error of the air flow meter 7. Therefore, it is necessary to judge if the fluctuations in the feedback correction coefficient FAF were due to the purge. The amount of reduction of the feedback correction coefficient FAF due to the purge, however, becomes larger than the amount of reduction of the feedback correction coefficient FAF due to other reasons. Considering the case where the feedback correction coefficient FAF is fixed and open loop control is performed, it is not possible to considerably reduce the feedback correction coefficient FAF. Thus, in the embodiment according to the present invention, as shown in FIG. 4, when the average value FAFAV of the feedback correction coefficient FAF falls by a certain degree, the fall of the feedback correction coefficient FAF is restrained. After the fall of the feedback correction coefficient FAF is restrained, the coefficient FPGA showing the concentration of the purge vapor per unit target purge rate is used to find the concentration of the purge vapor. Next, an explanation will be made of the coefficient FPGA referring to FIG. 5A, which shows an enlargement of the section a in FIG. 4.

Figure 5A:
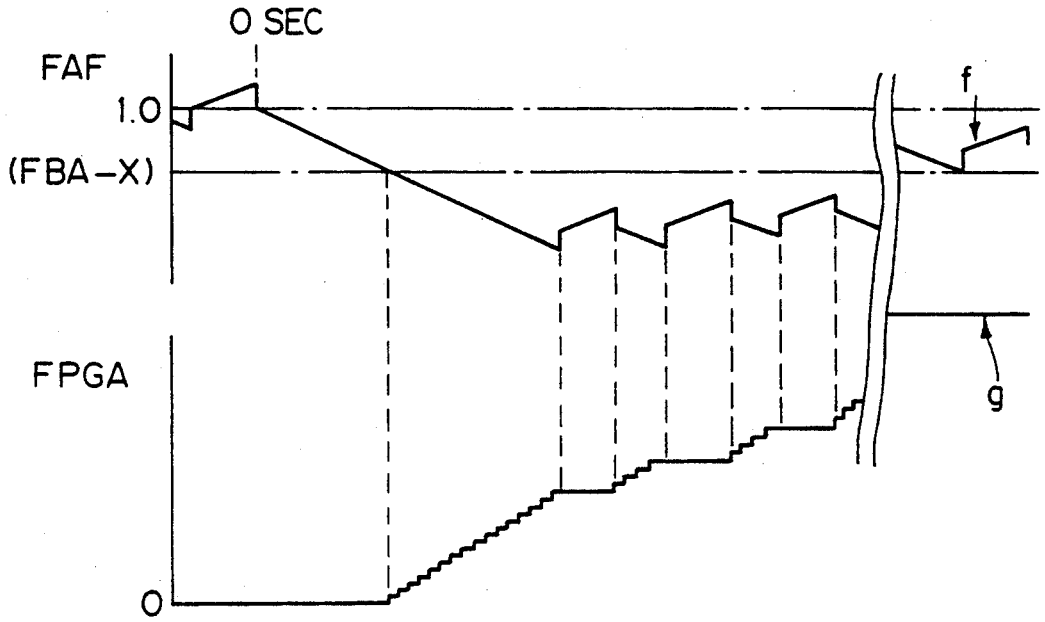
FIGS. 5A and 5B are time charts of the start of the purge.

FIG. 5A shows the changes in the feedback correction coefficient FAF when the purge action is started at 0 second and the purge vapor concentration coefficient FRPG per unit target purge rate. In the example shown in FIG. 5A, the feedback correction coefficient FAF is made to be reduced as much as possible below a lower threshold (FBA−X). As will be understood from FIG. 5A, when the feedback correction coefficient FAF becomes smaller than the lower threshold value (FBA−X) and the air-fuel ratio becomes rich, the purge vapor concentration coefficient per unit target purge rate is increased. The above-mentioned purge A/F correction coefficient FPG is expressed in the form of the negative of the product of the purge vapor concentration coefficient (FPGA) per unit target purge rate and the purge rate PRG corresponding to the target purge rate TGTPG (FPG=−FPGA·PRG) and therefore if the purge vapor correction coefficient FPGA per unit target purge rate increases, the amount of fuel injection is reduced as understood from the calculation equation of the fuel injection time TAU mentioned earlier. In other words, if the purge vapor concentration coefficient per unit target purge rate becomes larger, the amount of fuel injection is reduced, so the action reducing the feedback correction coefficient FAF is suppressed.

Next, an explanation will be made of the reasons for increasing the purge vapor concentration coefficient FPG per unit target purge rate when the feedback correction coefficient FAF becomes smaller than a lower threshold (FBA−X) and the air-fuel ratio becomes rich.

Figure 5B:
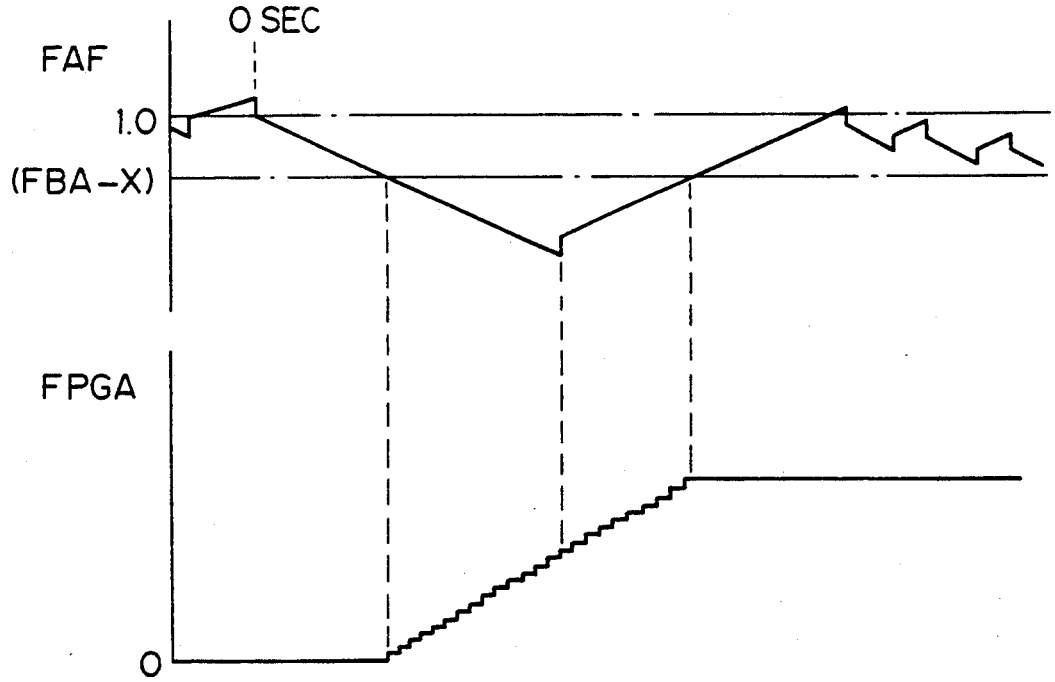

FIG. 5B shows, as a comparative example, the case where the FPGA is increased when the feedback correction coefficient FAF becomes lower than a lower threshold (FBA−X) and the air-fuel ratio is either rich or lean. Before the purge is started, there is a large amount of fuel vapor absorbed in the activated charcoal 10 in the canister 11. When the purge is started, both the fuel vapor not absorbed in the activated charcoal 10 and the fuel vapor absorbed in the activated charcoal 10 are purged into the surge tank 5. Therefore, even if the target purge rate TGTPG at the time of start of the purge is made small, the air-fuel mixture will become rich until the fuel vapor not absorbed in the activated charcoal 10 is finished being purged. Therefore, as shown in FIG. 5A and FIG. 5B, if the purge is started at 0 second, the feedback correction coefficient FAF falls beyond the lower threshold (FBA−X). If the feedback correction coefficient FAF goes beyond the lower threshold (FBA−X), the FPGA is increased, so the amount of fuel injection gradually falls. Then, when the air-fuel mixture becomes lean, the feedback correction coefficient FAF starts to increase.

When the feedback correction coefficient FAF becomes smaller than the lower threshold (FBA−X), however, and the FPGA is increased whether the air-fuel ratio is rich or lean, then, as shown in FIG. 5B, the FPGA continues to be increased even when the feedback correction coefficient FAF starts to be increased. If the FPGA continues to be increased in this way, however, then even if the feedback correction coefficient FAF increases to try to increase the amount of fuel injection, the amount of fuel injection is reduced by the increase of the FPGA, so the air-fuel mixture does not easily become rich. The air-fuel mixture becomes rich only a while after the feedback correction coefficient FAF becomes larger than the lower threshold (FBA−X) and the increasing action of the FPGA is stopped. That is, the air-fuel mixture becomes lean over a considerable period and, further, the air-fuel mixture during this period becomes thin, so not only does the air-fuel ratio fluctuate, but also the output torque of the engine falls temporarily, so an unpleasant feeling is given to the driver.

As opposed to this, when, as in the embodiment of the present invention, the feedback correction coefficient FAF falls beyond the lower threshold (FBA−X) and the air-fuel ratio becomes rich, if the FPGA is increased, the feedback correction coefficient FAF increases to try to increase the amount of fuel injection. If at this time, the FPGA is held to a constant value, there is no action of the FPGA in reducing the amount of fuel injection and thus, as shown in FIG. 5A, the air-fuel mixture changes quickly from lean to rich. In other words, the air-fuel ratio is quickly controlled to the stoichiometric air-fuel ratio. Therefore, right after the purge action is started, it becomes possible to prevent fluctuations in the air-fuel ratio separately. After this, the air-fuel ratio continues to be held at the stoichiometric air-fuel ratio and the feedback correction coefficient FAF rises little by little overall. After a while, as shown by f in FIG. 5A, the feedback correction coefficient FAF continues to fluctuate until its minimum value becomes the lower threshold (FBA−X). At this time, the FPGA is held to a constant value.

As mentioned earlier, the amount of the reduction in the feedback correction coefficient FAF is proportional to the concentration of purge vapor in the intake air. The FPGA increases by exactly the amount by which the feedback correction coefficient FAF should be reduced, so the concentration of purge vapor in the intake air may be expressed by the sum of the amount of reduction of the feedback correction coefficient FAF shown by f in FIG. 5A and the FPGA shown by g in FIG. 5A, more precisely speaking, the amount of reduction of the feedback correction coefficient FAF shown by f in FIG. 5A and the value obtained by multiplying the target purge rate to the FPGA shown by g in FIG. 7.

As shown in FIG. 4, if about 30 seconds from when the purge is started, it is attempted to make the purge rate PGR corresponding to the target purge rate the maximum one, the concentration of the purge vapor per unit purge rate falls and settles at a substantially constant value about 15 seconds after the start of the purge. After the concentration of purge vapor per unit purge rate is held substantially constant for more than several minutes, it gradually falls. Therefore, if things are allowed to continue for a while after 15 seconds elapses from the start of the purge, the FPGA will be maintained at a substantially constant value.

As mentioned earlier, the feedback correction coefficient FAF is preferably held at 1.0 and therefore, as shown in FIG. 4, the average value of the feedback correction coefficient FAF is brought close to 1.0 forcibly a little at a time every other 15 seconds. As mentioned earlier, the concentration of the purge vapor in the intake air is expressed as the sum of the amount of reduction of the feedback correction coefficient FAF and the value obtained by multiplying FPGA with the target purge rate, so when the feedback correction coefficient is forcibly raised, the FPGA is raised by exactly the amount corresponding to the amount of rise of the feedback correction coefficient FAF. Therefore, when the feedback correction coefficient FAF is returned to 1.0, the FPGA accurately expresses the concentration of purge vapor per unit purge rate. Note that as shown in FIG. 4, the FAFAV gradually falls during the period from 15 seconds to 30 seconds because the purge rate PRG corresponding to the target purge rate is increased during that period.

The purge A/F correction coefficient FPG shown in FIG. 4 is expressed, as mentioned above, in the form of the negative of the product of FPGA and the purge rate PRG (−FPGA·PRG). Here, the product of the purge vapor concentration coefficient FPGA per unit target purge rate and PGR expresses the concentration of the purge vapor, so the amount of decline of the purge A/F correction coefficient FPG expresses the concentration of the purge vapor. Further, the purge vapor concentration coefficient FPGA increases, so the purge vapor concentration increases comparatively rapidly. On the other hand, the purge vapor concentration coefficient FPGA is increased forcibly in 15 seconds, so the purge vapor concentration is also increased forcibly.

In the period from 15 seconds to 30 seconds, the purge vapor correction coefficient FPGA becomes constant, but since the purge rate PRG increases, the purge vapor concentration also is increased. Next, each time the purge vapor concentration coefficient FPGA is increased every 15 seconds, the purge vapor concentration is also increased. The sum of the purge vapor concentration and the amount of reduction of the feedback correction coefficient FAF expresses the concentration of the purge vapor in the intake air and therefore, as shown by the equation for calculating the fuel injection time TAU mentioned earlier, if the basic fuel injection time TP is corrected by the sum of the amount of decreases (1−FAF) of the feedback correction coefficient FAF and the purge A/F correction coefficient FPG, the air-fuel ratio is maintained at the stoichiometric air-fuel ratio. Note that if the feedback correction coefficient FAF becomes 1.0, the concentration of the purge vapor, expressed by FPG, comes to accurately express the concentration of the purge vapor in the intake air. After about 90 seconds passes from the start of the purge, FAFAV becomes substantially 1.0, so at that time, it is learned, the purge A/F correction coefficient FPG expresses the concentration of the purge vapor in the intake air.

As shown by B in FIG. 4, when the purge vapor rate PRG becomes maximum, even if there is acceleration and the amount of the intake air increases, basically, the duty ratio PGDUTY is increased in a state with the purge rate PRG held constant, as shown by the broken line in FIG. 4, so the air-fuel ratio never fluctuates. If, however, before the acceleration operation, the duty ratio PGDUTY becomes close to 100 percent as shown in FIG. 4, when acceleration is performed as shown by B, the duty ratio PGDUTY will end up reaching 100 percent. In this case, however, even if the target purge rate PRG had been held constant, as shown in FIG. 4, the actual purge rate PRG is reduced and, along with this, the purge A/F correction coefficient FPG is increased. At this time, the concentration of the purge vapor in the intake air falls, so the purge A/F correction coefficient FPG is increased by exactly an amount corresponding to the concentration of purge vapor, so the air-fuel ratio is maintained at the stoichiometric air-fuel ratio without fluctuation of the air-fuel ratio.

In an internal combustion engine as shown in FIG. 1, the fuel injection from the fuel injectors 4 is stopped during the deceleration operation of the engine. When the fuel injection is stopped, if the fuel vapor is purged, the fuel vapor is exhausted into the exhaust manifold 3 without burning. Therefore, the purge action must be stopped when the fuel injection is stopped. When the fuel injection should be stopped, the cut flag is set and when the cut flag is set, the purge action is stopped. Here, an explanation will be made of the processing routine for the cut flag referring to FIG. 6.

Figure 6:
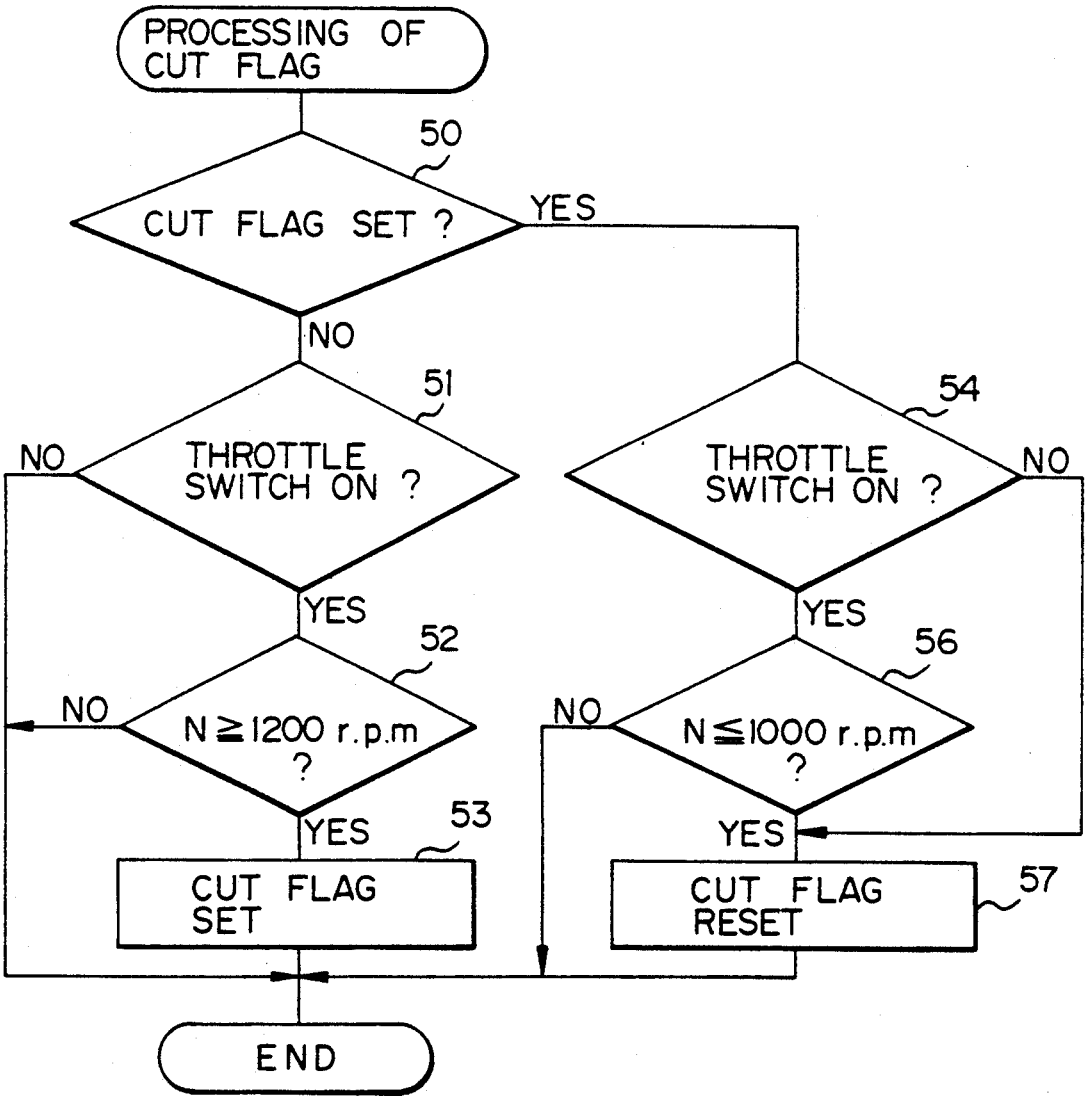
FIG. 6 is a flow chart for the control of the cut flag.

The cut flag processing routine shown in FIG. 6 is executed, for example, in a main routine.

Referring to FIG. 6, first, at step 50, it is determined if the cut flag is set. When the cut flag is not set, the routine proceeds to step 51, where it is determined if the throttle switch 28 is on or not, that is, if the throttle valve 9 is in the idling open position. When the throttle valve 9 is in the idling open position, the routine proceeds to step 52, where it is determined if the engine rotational speed N is a constant value, for example, over 1200 rpm. When $N \geqq 1200$ rpm, the routine proceeds to step 53, where the cut flag is set. That is, when the throttle valve 9 is in the idling open position and $N \geqq 1200$ rpm, it is determined that there is deceleration and the cut flag is set.

If the cut flag is set, the routine proceeds from step 50 to step 54, where it is determined if the throttle switch 28 is on or not, that is, if the throttle valve 9 is in the idling open position. When the throttle valve 9 is in the idling open position, the routine proceeds to step 56, where it is determined if the engine rotational speed N is lower than 1000 rpm. When $N \geqq 1000$ rpm, the routine proceeds to step 57, where the cut flag is reset. On the other hand, even when $N \geqq 1000$ rpm, if the throttle valve 9 is opened, the routine jumps from step 54 to step 57 and the cut flag is reset. If the cut flag is reset, the fuel injection is stopped.

Next, a more detailed explanation will be made of the method of purge control referring to FIGS. 4, 5A, and 5B and referring to FIGS. 7, 8A, 8B, 8C, and 8D.

Figure 7:
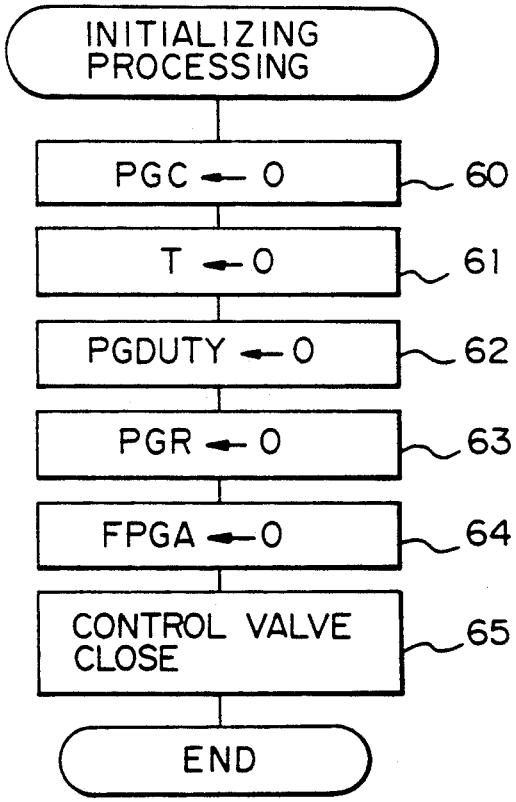
FIG. 7 is a flow chart for the initializing processing for the purge control.

FIG. 7 shows the initialization processing routine for purge control executed when the ignition switch (not shown) is turned on.

Referring to FIG. 7, first, at step 60, the purge count value PGC is cleared, then at step 61, the time count value T is cleared. Next, at step 62, the drive duty ratio PGDUTY for the purge control valve 17 is made zero, then at step 63, the purge rate PGR is made zero. Next, at step 64, the purge vapor concentration coefficient FPGA is made zero. Next, at step 65, the purge control valve 17 is opened, then the processing cycle is completed.

FIGS. 8A, 8B, 8C, and 8D show the purge control routine. This routine is executed by interruption every 1 msec.

Figure 8A:
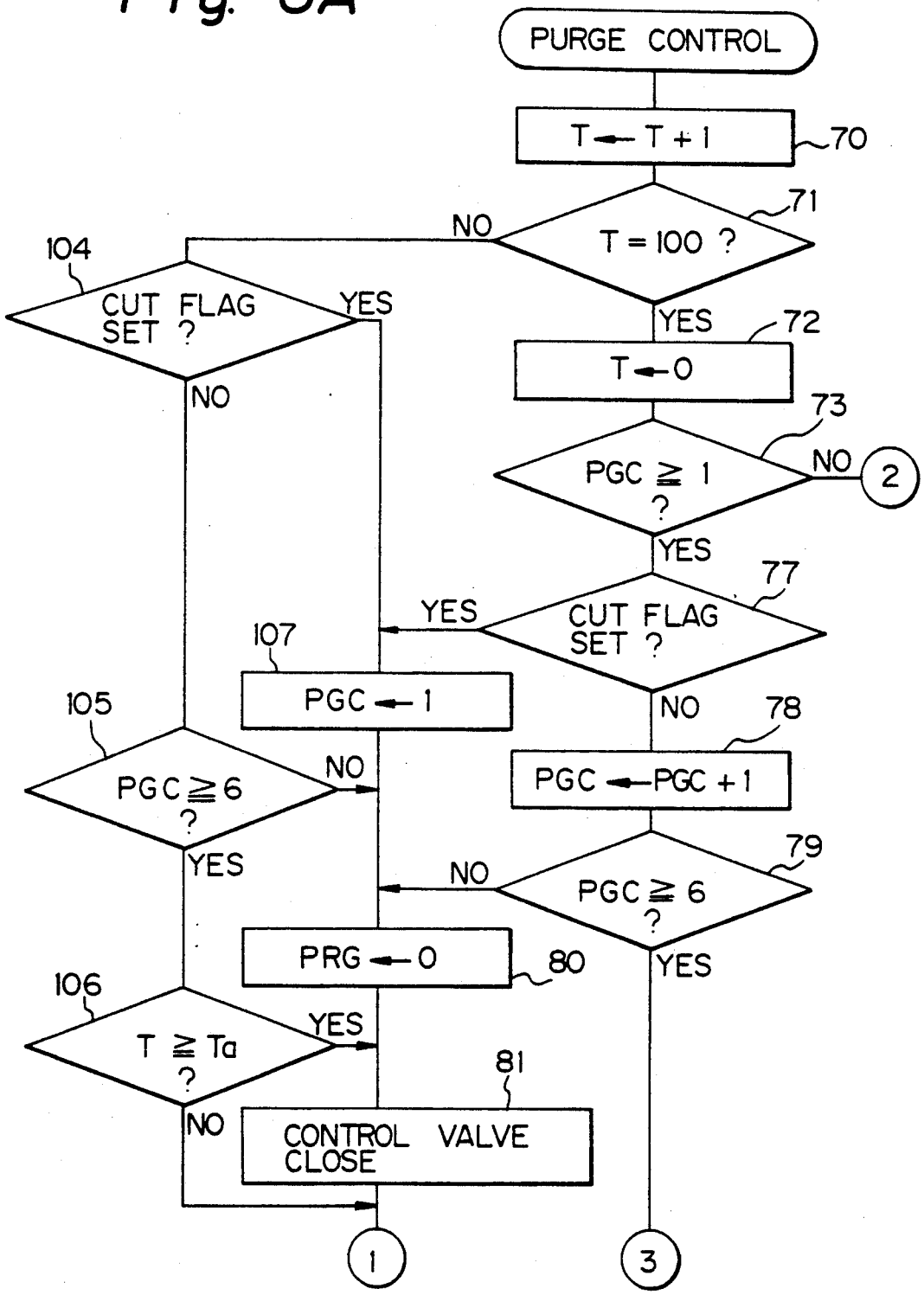
FIGS. 8A, 8B, 8C, and 8D are flow charts for the purge control.
Figure 8B:
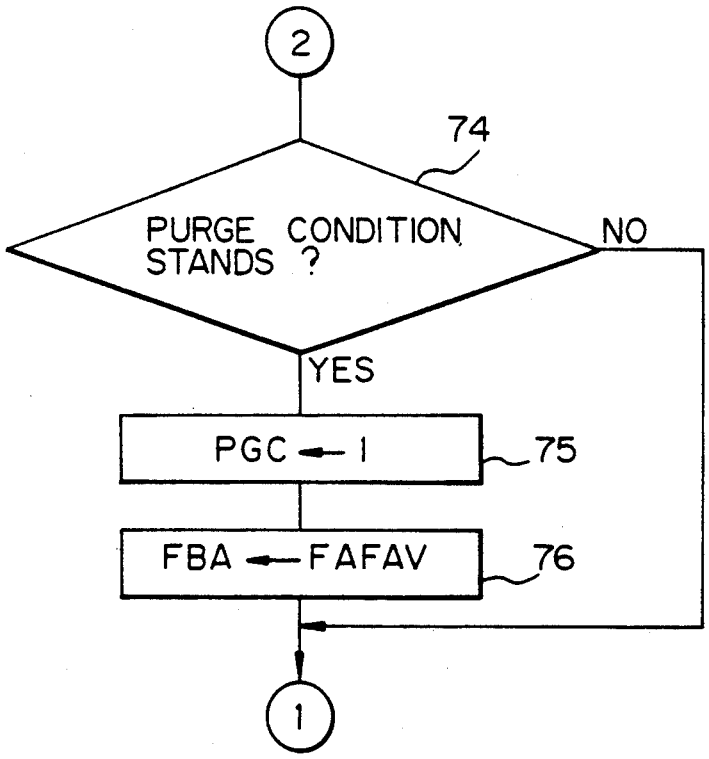

Referring to FIG. 8A, first, at step 70, the timer count value T is incremented by exactly 1. Next, at step 71, it is determined if the timer count value T is 100 or not. When $T=100$, the routine proceeds to step 72. Therefore, at step 72, the routine proceeds every 100 msec. At step 72, the timer count value T is cleared, then the routine proceeds to step 73. At step 73, it is determined if the purge count value PGC is larger than 1. When the routine proceeds to step 73 for the first time after the ignition switch was turned on, the purge count value PGC is zero, so the routine proceeds to step 74 shown in FIG. 8B.

At step 74, it is determined if the conditions for starting the purge control have been established. When the engine cooling water temperature is 70° C., the feedback control of the air-fuel ratio has started, and the skip processing for the feedback correction coefficient FAF (S in FIG. 3) has been performed 5 times or more, it is determined that the conditions for starting the purge control have been established. When the conditions for starting the purge control have not been established, the processing cycle is ended. On the other hand, when the conditions for starting the purge control have been started, the routine proceeds to step 75, where the purge count value PGC is made 1. Next, at step 76, the average value FAFAV of the feedback correction coefficient FAF calculated in the routine shown in FIG. 2 is made FBA. Therefore, FBA expresses the average value FAFAV of the feedback correction coefficient FAF when the conditions for starting the purge control have been established. Next, the processing cycle is ended.

When it is determined that the conditions for starting the purge control have been established, it is determined at step 73 in FIG. 8A that the purge count value $PGC \geqq 1$, so the routine proceeds to step 77. At step 77, it is determined if the cut flag is set, that is, if the fuel injection is stopped. When the cut flag is not set, the routine proceeds to step 78, where the purge count PGC is incremented by exactly 1, then at step 79, it is determined if the purge count value PG is larger than 6. When the purge count value $PGC<6$, the routine proceeds to step 80, where the purge rate PRG is made zero. Next, at step 81, the purge control valve 17 is closed. At this time the purge control valve 17 is already closed, so the purge control valve 17 is held i the closed state. As opposed to this, at step 79, if it is determined that the purge count value $PGC \geqq 6$, that is, 500 msec have passed since the conditions for starting the purge control were established, the routine proceeds to step 82 in FIG. 8C.

The routine from step 82 to step 91 is the portion for calculating the purge vapor concentration. This portion will be explained later. Next, at step 92, the maximum purge rate MAXPG corresponding to the engine load Q/N and the engine rotational speed N is calculated from the afore-mentioned Table 1 stored in the ROM 22. Next, at step 93, the target purge rate TGTPG is calculated by adding a predetermined constant purge change rate PGA to the purge rate PGR. Therefore, the target purge rate TGTPG is increased by PGA every 100 msec. Next, the routine proceeds to step 94 in FIG. 8D.

At step 94, it is determined if the target purge rate TGTP is larger than 0.04, that is, 4 percent. When $TGTPG<0.04$, the routine jumps to step 96, while when $TGTPG \geqq 0.04$, the routine proceeds to step 95, where TGTPG is made 0.04, then the routine proceeds to step 95. That is, when the target purge rate TGTPG becomes large and the amount of purge becomes too large, it becomes difficult to hold the air-fuel ratio at the stoichiometric air-fuel ratio. Therefore, the target purge rate TGTPG must be prevented from becoming larger than 4 percent.

Next, at step 96, the drive duty ratio PGDUTY of the purge control valve 17 is calculated based on the following equation:

Duty ratio PGDUTY=(Target purge rate TGTPG/Maximum purge rate MAXPG)·100

Next, at step 97, it is determined if the duty ratio PGDUTY is over 100, that is, is over 100 percent. When PGDUTY≧100, the routine jumps to step 99, while when PGDUTY≧100, the routine proceeds to step 98, where the duty ratio PGDUTY is made 100, then the routine proceeds to step 99. At step 99, the timer count Ta when the purge control valve 17 is closed is made the duty ratio PGDUTY. Next, at step 100, the actual purge rate PRG is calculated based on the following equation:

Actual purge rate PGR=(Maximum purge rate MAXPG·Duty ratio PGDUTY)·100

That is, in the calculation of the duty ratio PGDUTY at step 96, when the maximum purge rate MAXPG becomes smaller and (TGTPG/MAXPG)·100 exceeds 100, the duty ratio PGDUTY is fixed to 100, so in this case the actual purge rate PGT becomes smaller than the target purge rate TGTPG. That is, when the purge control valve 17 is fully open, if the maximum purge rate MAXPG becomes smaller, the actual purge rate PGT will fall along with it. Note that so long as (TGTPG/MAXPG)·100 does not exceed 100, the actual purge rate PGT matches the target purge rate TGTPG.

Next, at step 101, it is determined if the duty ratio PGDUTY is larger than 1. When PGDUTY<1, the routine proceeds to step 102, where the purge control valve 17 is closed, then the processing routine is ended. As opposed to this, when PGDUTY≧1, the routine proceeds to step 103, where the purge control valve 17 is opened, then the processing cycle is ended.

At the next processing cycle, the routine proceeds from step 71 in FIG. 8A to step 104, where it is determined if the cut flag is set. When the cut flag is not set, the routine proceeds to step 105, where it is determined if the purge counter PGC is larger than 6. At this time, PGC is equal to 6, so the routine proceeds to step 106, where it is determined if the timer count value T is larger than Ta. When T<Ta, the processing cycle is ended. When T≧Ta, the purge control valve 17 is closed. Therefore, when PGC becomes larger than 6, that is, when 500 msec have elapsed from the start of the purge control, the purge control valve 17 is opened and the supply of the purge gas is started. At this time, the period of opening of the purge control valve 17 matches the duty ratio PGDUTY. Next, along with the increase of the purge count value PGC, the target purge rate TGTPG becomes larger, so along with this the duty ratio PGDUTY increases and therefore the amount of purge vapor is gradually increased. During this time, as shown in A of FIG. 4, if the amount Q of intake air increases, then as mentioned above, the duty ratio PGDUTY is increased and the actual purge rate PRG is increased by a constant rate.

Figure 8C:
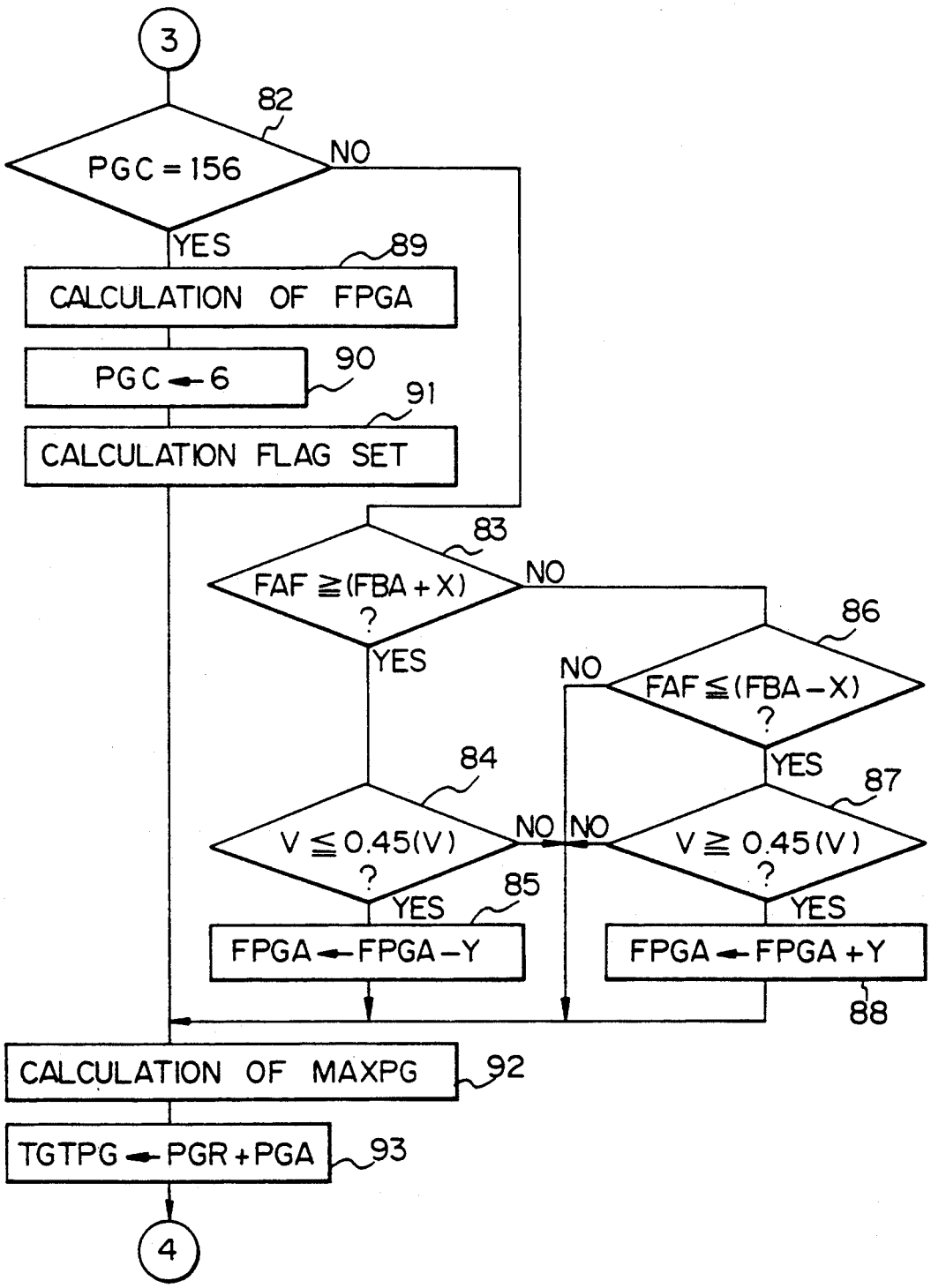
Figure 8D:
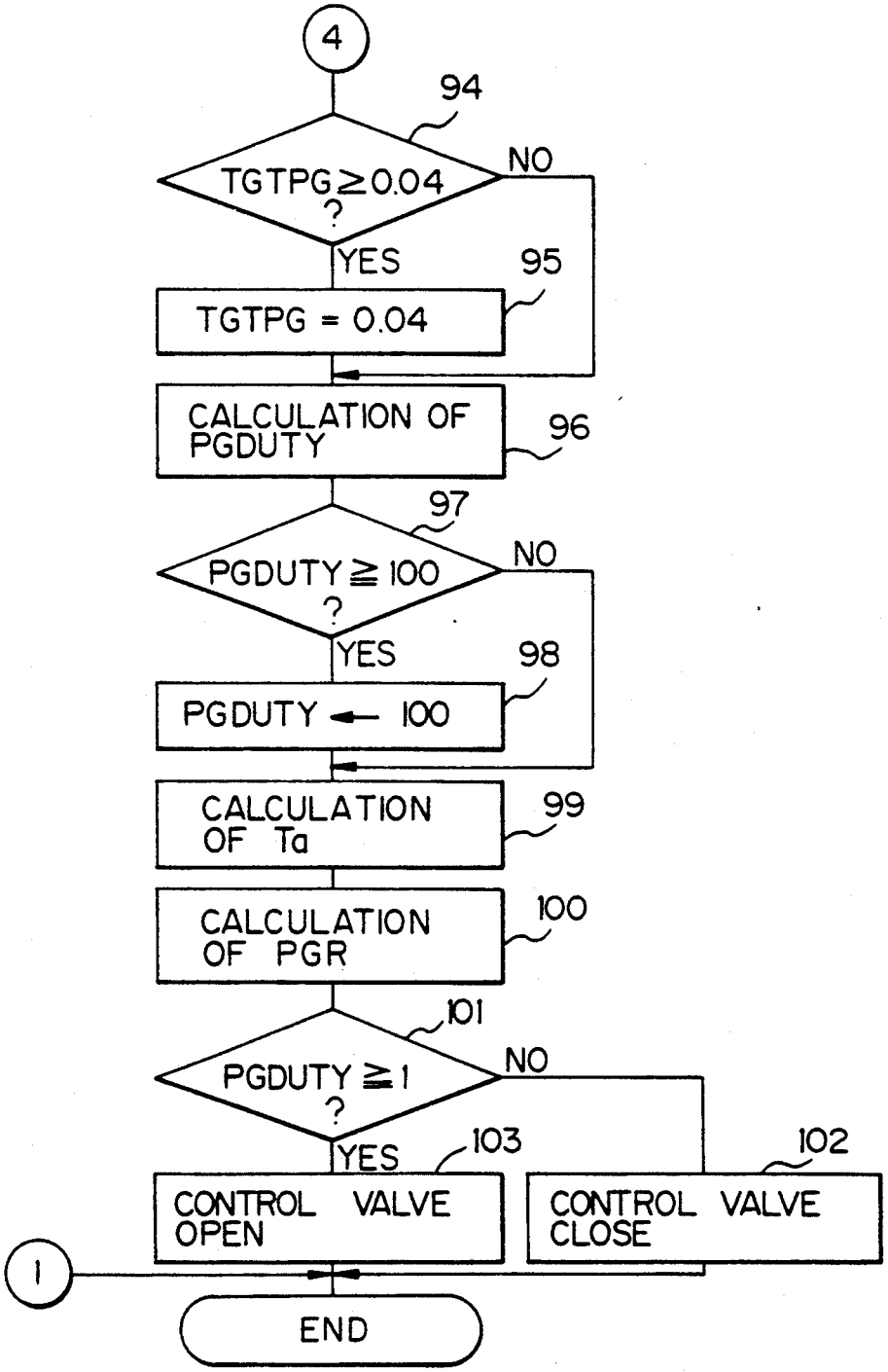

Next, an explanation will be made of step 82 to step 91 in FIG. 8C. At step 82, it is determined if the purge counter PGC is 156 or not. When the routine has proceeded to step 82 for the first time after the purge control has been started, PGC is equal to 6, so the routine proceeds to step 83. At step 83, it is determined if the feedback correction coefficient FAF is larger than an upper threshold value (FBA+X). Here, FBX is the average value FAFAV of the feedback correction coefficients FAF at the time of start of purge control and X is a small constant value. When FAF<(FBA+X), the routine proceeds to step 86.

At step 86, it is determined if the feedback correction coefficient FAF is smaller than a lower threshold (FBA−X) shown in FIG. 5A. When FAF>(FBA−X), the routine proceeds to step 92. As opposed to this, when FAF≦(FBA−X), the routine proceeds to step 87, where it is determined if the output voltage of the $O_1$ sensor 31 is higher than 0.45 V or not, i.e., if the air-fuel ratio is rich. When it is lean, the routine proceeds to step 92, while when it is rich, the routine proceeds to step 88, where a constant value Y is added to the purge vapor correction coefficient FPGA, then the routine proceeds to step 92. Therefore, as shown in FIG. 5A, when FAF≦(FBA−X) and the air-fuel ratio is rich, the purge vapor correction coefficient FPGA is increased by constant values Y.

On the other hand, when FAF≧(FBA+X) at step 83, the routine proceeds to step 84, where it is determined if the output voltage V of the $O_2$ sensor 31 is lower than 0.45 V, that is, if the air-fuel ratio is lean. When it is rich, the routine proceeds to step 92. As opposed to this, when it is lean, the routine proceeds to step 85, where the constant value Y is subtracted from the purge vapor correction coefficient FPGA, where the routine proceeds to step 92. Therefore, when the feedback correction coefficient FAF is larger than the upper threshold (FBA+X) and the air-fuel ratio is lean, the purge vapor correction coefficient FPGA is decreased by constant values Y. If this is done, the air-fuel ratio will no longer fluctuate after FAF exceeds the upper threshold value (FBA+X).

On the other hand, if it is determined at step 82 that PGC−156, that is, if 15 seconds have elapsed after the routine first proceeds to step 82, the routine proceeds to step 89, where the purge vapor concentration coefficient FPGA is calculated based on the following equation:

$$FPGA=FPGA-(FAFAV-FBA)/(\text{Purge rate PRG}\cdot 2)$$

That is, half of the difference per unit purge rate PRG of the current feedback correction coefficient average value FAFAV and the feedback correction coefficient average value FBA at the time of the start of the purge is subtracted from the FPGA. As shown in FIG. 4, if FAFAV becomes smaller than FBA, as show in FIG. 4, the purge vapor concentration coefficient FPGA is increased. Next, at step 90, the purge count PGC is made 6. Therefore, it is learned that the routine proceeds to step 89 every 15 seconds. Next, at step 91, the calculation flag indicating that the calculation of the FPGA of step 89 has been completed is set and the routine proceeds to step 92.

On the other hand, at step 77 or step 104 of FIG. 8A, when it is determined that the cut flag has been set, the routine proceeds to step 107, where the purge count PGC is made 1. Next, at step 80, the purge rate PRG is made zero, then at step 81, the purge control valve 17 is made to open. That is, if the cut flag is set, the purge action is stopped. The purge action is started again after the PGC reaches 6.

Figure 9:
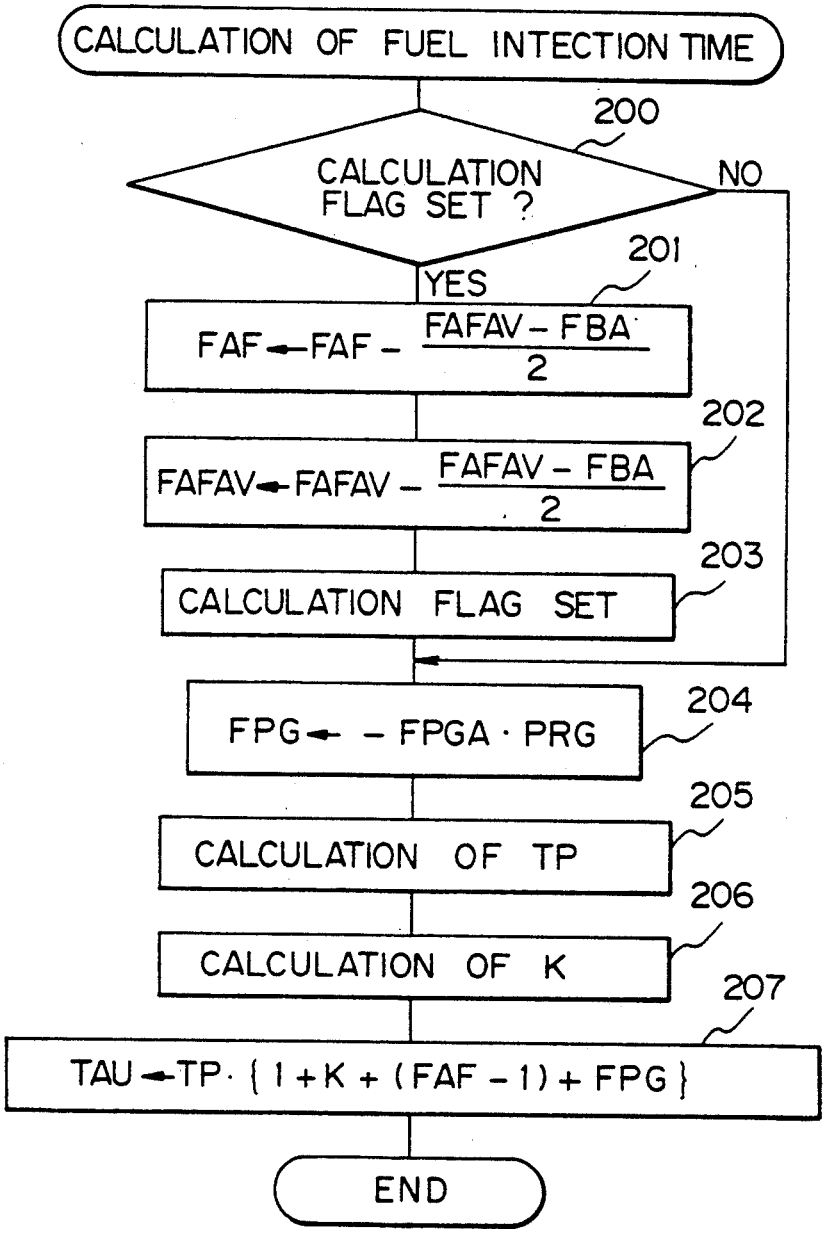
FIG. 9 is a flow chart for calculation of the fuel injection timing.

FIG. 9 shows a routine for calculating the fuel injection time. This routine is executed by interruption at each certain crank angle.

Referring to FIG. 9, first, at step 200, it is determined if the calculation flag is set. When the calculation flag is not set, the routine jumps to step 204. When the calculation flag is set, the routine proceeds to step 201, where half of the difference of the current feedback correction coefficient average value FAFAV and the feedback correction coefficient average value FBA at the time of the start of the purge control is subtracted from the feedback correction coefficient FAF. The calculation flag is set every other 15 seconds, so the processing is executed every other 15 seconds. As shown in FIG. 4, when FAFAV becomes smaller than FBA, as shown in FIG. 4, FAF is increased by exactly half of the amount of reduction of the feedback correction coefficient FAF. That is, as shown in FIG. 4, FAF is raised by exactly half of the amount of reduction of FAF every 15 seconds and at that time the purge vapor concentration coefficient FPGA is increased by exactly an amount corresponding to the amount of increase of FAF.

Next, at step 202, (FAFAV−FBA)/2 is subtracted from FAFA to change FAFAV by exactly the amount of the change of FAF. Next, at step 203, the calculation flag is reset and the routine proceeds to step 204. At step 204, the purge A/F correction coefficient FPG is calculated based on the following equation:

Purge A/F correction coefficient FPG = −(purge vapor concentration coefficient FPGA·purge rate PRG)

The change of the purge A/F correction coefficient FPG is shown in FIG. 4. Next, at step 205, the basic fuel injection time TP is calculated, then at step 206, the correction coefficient K is calculated. Next, at step 207, the fuel injection time TAU is calculated based on the following equation:

$$TAU = TP \cdot \{1 + K + (FAF - 1) + FPG\}$$

The fuel is injected from the injection valves 4 based on the fuel injection time TAU.

According to the present invention, it is possible to prevent the fluctuation of the air-fuel ratio even where there is transitory operation of the engine during a purge.

While the invention has been described by reference to specific embodiments chosen for purposes of illustration, it should be apparent that numerous modifications could be made thereto by those skilled in the art without departing from the basic concept and scope of the invention.

We claim:

1. A fuel supply control device of an engine having an exhaust passage and an intake passage which has a throttle valve therein, said device comprising:

a charcoal canister temporarily storing fuel vapor therein;

a purge passage connecting said charcoal canister to the intake passage downstream of the throttle valve;

a purge control valve arranged in said purge passage to control an amount of the fuel vapor purged into the intake passage;

reference purge rate calculating means for calculating a reference purge rate which is a ratio of the amount of the fuel vapor purged into the intake passage to an amount of air fed into the engine and is determined by an engine operating state for the same degree of opening of said purge control valve;

target purge rate setting means for determining a target purge rate;

opening operation control means for controlling a rate of the opening operation of said purge control valve on the basis of a ratio of said target purge rate to said reference purge rate;

fuel amount calculating means for calculating an amount of fuel fed into the engine;

air-fuel ratio detecting means arranged in the exhaust passage to detect an air-fuel ratio;

first fuel amount correcting means for correcting the amount of fuel by a feedback correction coefficient on the basis of an output signal of said air-fuel ratio detecting means to make an air-fuel ratio equal to a target air-fuel ratio;

vapor concentration calculating means for calculating a concentration of the fuel vapor in an air fed into the engine on the basis of a deviation of said feedback correction coefficient from a reference value, which deviation is caused when the fuel vapor is purged into the intake passage; and second fuel amount correcting means for reducing the amount of fuel on the basis of said concentration of the fuel vapor when the fuel vapor is purged into the intake passage.

2. A fuel supply control device as set forth in claim 1, wherein the basic purge rate is the ratio of the amount of fuel vapor to the amount of air when the purge control valve is fully opened.

3. A fuel supply control device as set forth in claim 1, wherein the reference purge rate is determined by the engine load Q/N and the engine rotational speed N.

4. A fuel supply control device as set forth in claim 1, wherein the target purge rate is gradually increased after the purge action of the fuel vapor is started.

5. A fuel supply control device as set forth in claim 4, wherein the target purge rate is maintained at a predetermined upper limit after reaching that limit.

6. A fuel supply control device as set forth in claim 1, wherein said opening operation control means causes the rate of opening of the purge control valve to increase the larger the ratio of the target purge rate to the reference purge rate.

7. A fuel supply control device as set forth in claim 6, wherein said opening operation control means causes the rate of opening of the purge control valve to increase by enlarging the duty ratio of the opening time of the purge control valve.

8. A fuel supply control device as set forth in claim 1, wherein said vapor concentration calculating means calculates the concentration of the fuel vapor per unit target purge rate based on the deviation of the feedback correction coefficient from a reference value and said second fuel amount correcting means causes the amount of fuel to be reduced based on the product of the concentration of fuel vapor per unit target purge rate and the target purge rate.

9. A fuel supply control device as set forth in claim 1, wherein said second fuel amount correcting means causes the amount of fuel to be gradually reduced so that the feedback correction coefficient becomes gradually closer to the reference value.

10. A fuel supply control device as set forth in claim 1, wherein said second fuel amount correcting means has a reducing action on the amount of fuel when the air-fuel ratio becomes smaller than the target air-fuel ratio.

11. A fuel supply control device as set forth in claim 1, wherein the amount of fuel TAU actually supplied to the engine is expressed by the following equation:

$$TAU = TP \cdot \{1 + K + (FAF - 1) + FPG\}$$

where, the coefficients express the following:

TP: Basic fuel injection amount calculated by said fuel amount calculating means K: Correction coefficient FAF: Feedback correction coefficient FPG: Correction value of fuel amount calculated by said second fuel amount correcting means

12. A fuel supply control device as set forth in claim 11, wherein said reference value of said feedback correction coefficient FAF is 1.0.

13. A fuel supply control device as set forth in claim 12, further comprising means for calculating the average value FBA of the feedback correction coefficient FAF when the purge action of the fuel vapor is started and wherein the correction value FPG is reduced when the feedback correction coefficient FAF becomes smaller than (FBA−X) (where X is a positive set integer) and the air-fuel ratio becomes smaller than the target air-fuel ratio.

14. A fuel supply control device as set forth in claim 13, further comprising means for calculating an actual purge rate PGT from a product of the reference purge rate and the rate of opening of the purge control valve and wherein when the correction value FPG is calculated from the product of the correction value FPGA per unit purge rate, the feedback correction coefficient FAF becomes smaller than (FBA−X), and the air-fuel ratio becomes smaller than the target air-fuel ratio, the correction value FPGA per unit purge rate is reduced.

15. A fuel supply control device as set forth in claim 13, further comprising means for calculating a current average value FAFAV of the feedback correction coefficient FAF and means for renewing the average value FAFAV based on the following equations every certain time:

$$FAF = FAF - (FAFAV - FBA)/3$$

$$FAFAV = FAFAV - (FAFAV - FBA)/2$$

16. A fuel supply control device as set forth in claim 1, wherein further comprising means for stopping the supply of fuel when the engine is decelerated and means for stopping the purge action of the fuel vapor when the supply of fuel is stopped.

* * * * *

UNITED STATES PATENT AND TRADEMARK OFFICE

CERTIFICATE OF CORRECTION

PATENT NO. : 5,216,997 Page 1 of 2

DATED : June 8, 1993

INVENTOR(S) : Akinori Osanai, et al

It is certified that error appears in the above-indentified patent and that said Letters Patent is hereby corrected as shown below:

On the title page, Item [75]: Inventors: change "Toru Kodokoro" to --Toru Kidokoro--.

Column 6, line 12, change "0.18" to --0.15--.

Column 6, line 13, in each instance it occurs, change "28.6" to --25.6--, and also change "18.0" to --15.0--.

Column 6, line 14, change "8.7" to --5.7--.

Column 6, line 15, change "1.8" to --1.5--.

Column 6, line 16, change "8.3" to --5.3--, and "0.8" to --0.6--.

UNITED STATES PATENT AND TRADEMARK OFFICE

CERTIFICATE OF CORRECTION

PATENT NO. :5,216,997

DATED :June 8, 1993

INVENTOR(S) :Akinori OSANAI, et al.

It is certified that error appears in the above-indentified patent and that said Letters Patent is hereby corrected as shown below:

Column 7, line 59, change "falls" to --fails--.

Column 14, line 21, change "$O_1$" to --$O_2$--.

Column 14, line 47, change "PGC-156" to --PGC=156--.

Column 18, line 24, change "3" at end of line to --2--

Signed and Sealed this

Tenth Day of May, 1994

Bruce Lehman

*Attest:*

BRUCE LEHMAN

*Attesting Officer*

*Commissioner of Patents and Trademarks*